US009995156B2

(12) United States Patent
Jablonski et al.

(10) Patent No.: US 9,995,156 B2
(45) Date of Patent: Jun. 12, 2018

(54) TURBOMACHINE VANE HAVING AN AIRFOIL DESIGNED TO PROVIDE IMPROVED AERODYNAMIC AND MECHANICAL PROPERTIES

(71) Applicant: SNECMA, Paris (FR)

(72) Inventors: Laurent Jablonski, Moissy-Cramayel (FR); Hanna Reiss, Moissey-Cramayel (FR); Jerome Talbotec, Moissy-Cramayel (FR); Sandrine Quevreux, Moissy-Cramayel (FR)

(73) Assignee: SNECMA, Paris (FR)

( * ) Notice: Subject to any disclaimer, the term of this patent is extended or adjusted under 35 U.S.C. 154(b) by 399 days.

(21) Appl. No.: 14/414,307

(22) PCT Filed: Jun. 28, 2013

(86) PCT No.: PCT/FR2013/051522
§ 371 (c)(1),
(2) Date: Jan. 12, 2015

(87) PCT Pub. No.: WO2014/009628
PCT Pub. Date: Jan. 16, 2014

(65) Prior Publication Data

US 2015/0192024 A1 Jul. 9, 2015

(30) Foreign Application Priority Data

Jul. 12, 2012 (FR) ..... 12 56746

(51) Int. Cl.
*F01D 9/02* (2006.01)
*F01D 5/14* (2006.01)
(Continued)

(52) U.S. Cl.
CPC ..... *F01D 9/02* (2013.01); *F01D 5/141* (2013.01); *F04D 29/324* (2013.01); *F04D 29/384* (2013.01); *F05D 2220/36* (2013.01)

(58) Field of Classification Search
CPC ..... F01D 5/12; F01D 5/16; F01D 5/14; F01D 5/141; F01D 5/147; F01D 9/02;
(Continued)

(56) References Cited

U.S. PATENT DOCUMENTS 4,012,172 A 3/1977 Schwaar et al.
5,088,892 A 2/1992 Weingold et al.
(Continued)

FOREIGN PATENT DOCUMENTS

EP 0 441 097 A1 8/1991
EP 1 106 836 A2 6/2001
(Continued)

OTHER PUBLICATIONS

Nageswara Rao Muktinutalapati (2011). Materials for Gas Turbines—An Overview, Advances in Gas Turbine Technology, Dr. Ernesto Benini (Ed.), ISBN: 978-953-307-611-9, InTech, Available from: http://www.intechopen.com/books/advances-in-gas-turbine-technology/materials-for-gas-turbines-an-overview.*
(Continued)

*Primary Examiner* — Woody Lee, Jr.
*Assistant Examiner* — Sang K Kim
(74) *Attorney, Agent, or Firm* — Oblon, McClelland, Maier & Neustadt, L.L.P.

(57) ABSTRACT

A turbomachine vane including a plurality of vane sections stacked along a radial axis, each vane section extending along a longitudinal axis between a leading edge and a trailing edge, and along a tangential axis between an active surface and a passive surface, the vane sections being distributed according to longitudinal and tangential distri-
(Continued)

bution laws defining positioning of respective centers of gravity thereof in relation to the longitudinal and tangential axes according to a height of the vane extending from a foot of the vane to a top thereof. Each of the longitudinal and tangential distribution laws involves a change in direction of the slope at between 90% and 100% of the height of the vane.

7 Claims, 4 Drawing Sheets

(51) Int. Cl.
*F04D 29/32* (2006.01)
*F04D 29/38* (2006.01)

(58) Field of Classification Search
CPC .. F04D 29/324; F04D 29/384; F05D 2220/36; F05D 2240/10; F05D 2240/12; F05D 2240/121; F05D 2240/122; F05D 2240/123; F05D 2240/124; F05D 2240/125; F05D 2240/301; F05D 2250/70; F05D 2250/71
See application file for complete search history.

(56) References Cited

U.S. PATENT DOCUMENTS 6,331,100 B1 12/2001 Liu et al.
7,108,486 B2 * 9/2006 Talbotec ..... F01D 5/141 416/223 A
8,425,185 B2 * 4/2013 Myoren ..... F01D 5/141 415/192
2002/0141863 A1 10/2002 Liu et al.
2008/0107538 A1 * 5/2008 Bois ..... F01D 5/141 416/223 A
2008/0181769 A1 * 7/2008 Wilson ..... F01D 5/141 415/181
2009/0013532 A1 * 1/2009 Wood ..... F01D 5/141 29/889.7
2010/0150729 A1 * 6/2010 Kirchner ..... F01D 5/12 416/223 R
2013/0170977 A1 * 7/2013 Bielek ..... F01D 5/145 415/208.2
2013/0266451 A1 * 10/2013 Pesteil ..... F01D 5/141 416/223 R

FOREIGN PATENT DOCUMENTS

WO WO 2012080669 A1 * 6/2012 ..... F01D 5/141
WO 2012/090736 A1 7/2012

OTHER PUBLICATIONS

International Search Report dated Oct. 14, 2013 in PCT/FR2013/051522 filed Jun. 28, 2013.
Preliminary Search Report dated Apr. 9, 2013 in French Patent Application No. FR 1256746 (with English translation of category of cited documents).

* cited by examiner

TURBOMACHINE VANE HAVING AN AIRFOIL DESIGNED TO PROVIDE IMPROVED AERODYNAMIC AND MECHANICAL PROPERTIES

GENERAL TECHNICAL FIELD

This invention relates to the field of turbomachine vanes, and has a particular application for the metal vanes of the fan, of the high-pressure compressor or of the low-pressure compressor of a turbomachine.

STATE OF THE ART

The vanes of a turbomachine are subjected to substantial rotation speeds; the aerodynamic and mechanical performance of the vanes is therefore capital in providing a good operation of the turbomachine.

Several propositions have already been made in order to improve the performance of vanes by intervening on the geometry thereof.

Document FR 2908152 in the name of the applicant can in particular be mentioned, wherein it is proposed to vary the geometry of the vane along the height thereof.

More precisely, this document proposes to improve the aerodynamic performance of a vane by conferring upon it a geometry described as the combination of a relatively low and pronounced underside with a highly pronounced rear deflection in the longitudinal and tangential directions.

However, despite the increased aerodynamic performance obtained thanks to such a vane, the operation thereof is delicate due to the impact of this particular geometry on the mechanical resistance thereof, and more precisely due to the impact of this geometry on certain resonance modes of the vane.

PRESENTATION OF THE INVENTION

This invention aims to overcome this situation by proposing a vane that associates high aerodynamic and mechanical performance.

To this effect, the invention proposes a turbomachine vane comprising a plurality of vane sections stacked along a radial axis, with each vane section extending along a longitudinal axis between a leading edge and a trailing edge, and along a tangential axis between a pressure surface and a suction surface, with the vane sections being distributed according to longitudinal Xg and tangential Yg distribution laws defining the positioning of the respective centres of gravity thereof with respect to said longitudinal and tangential axes according to the height of the vane extending from the foot of the vane to the top thereof, characterised in that, in a top section of the vane located between 90 and 100% of the height H of the vane

- there is a first height starting from which the longitudinal Xg distribution law carries out a return towards the leading edge of the vane,
- there is a second height starting from which the tangential Yg distribution law carries out a return towards the suction surface of the vane.

Alternatively, said first and second heights are between 90% and 95% of the height H of the vane.

According to a particular embodiment, said first and second heights are equal.

Said vane is typically made of metal material.

The invention also relates to a turbomachine fan, a low-pressure compressor or a high-pressure compressor comprising a plurality of vanes such as defined hereinabove.

The invention further relates to a turbomachine comprising a plurality of vanes such as defined hereinabove.

PRESENTATION OF THE FIGURES

Other characteristics and advantages of the invention shall appear in the following description, which is purely for the purposes of illustration and is not restricted, and which must be read with regards to the annexed drawings, wherein.

DETAILED DESCRIPTION

Figure 1:
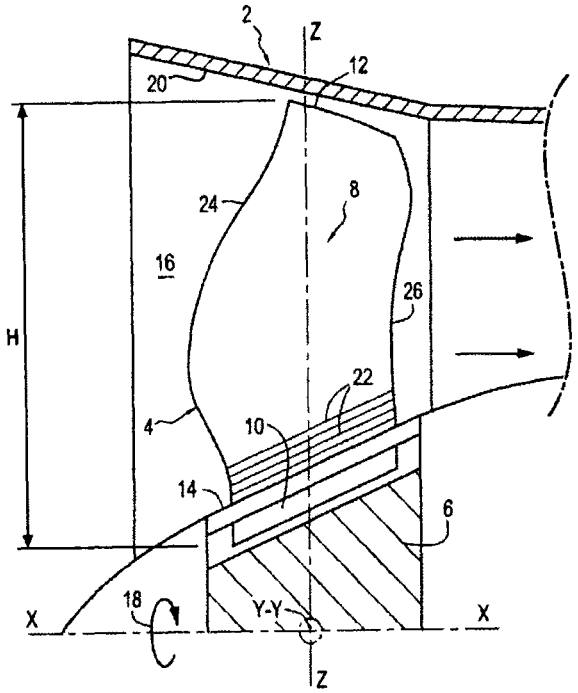
FIG. 1 is a partial longitudinal cross-section view of a fan of a turbomachine according to prior art.

FIG. 1 diagrammatically and partially shows the fan 2 of a turbomachine, typically a turbojet having a use in aeronautics.

The fan 2 is composed of a plurality of vanes 4 regularly spaced around a disc 6 (commonly referred to as a hub) of a rotor centred on a longitudinal axis X-X of the fan 2.

Each vane 4 commonly comprises a blade 8, a foot 10 and a top 12. The foot 10 of the vane is mounted on the disc 6 of the rotor and is connected to the blade 8 by the intermediary of a platform 14 that delimits the gas stream 16 passing through the fan 2. The disc 6 of the rotor is driven in rotation about the longitudinal axis X-X in the direction indicated by the arrow 18.

The top 12 of the vane is located opposite the inner face 20 of a fixed casing of the fan, with this face 20 also delimiting the stream 16, which is therefore between the platform 14 and the inner face 20 of the casing.

The blade 8 is comprised of a plurality of vane sections 22 that are stacked along a radial axis Z-Z perpendicular to the axis X-X. The vane sections 22 are located at increasing radial distances from the longitudinal axis X-X. The stack that results forms an aerodynamic surface that extends along a longitudinal axis X-X between a leading edge 24 and a trailing edge 26 and along a tangential axis Y-Y of the fan between a pressure surface, opposite the traction, and a suction surface, on the side of the traction (not shown in the figures).

The vane has a height H, measured from the foot 10 towards the top 12 of the vane according to the radial axis Z-Z. It is defined that the section of the vane located at 0% of the height H corresponds to the radius of intersection between the leading edge 24 and the inside stream of the flow of the gas stream, and the section located at 100% of the height H corresponds to the point at the radius of intersection between the leading edge 24 and the upper stream of the flow of the gas stream.

The longitudinal axis X-X, the tangential axis Y-Y and the radial axis Z-Z of the fan defined as such form a direct orthonormal trihedron.

This invention is applied to different types of mobile vanes of a turbomachine; for example the mobile fan vanes, of a high-pressure compressor, i.e. the compressor upstream of the direction of flow of the stream, and of a high-pressure compressor, i.e. the compressor downstream in the direction of the flow of the stream.

FIG. 1 which shows a partial view of a turbomachine fan is purely for the purposes of illustration, and makes it possible in particular to define the various axes of the turbomachine.

It is indeed understood that the following description can also be transposed for vanes of a turbomachine other than the vanes of the fan, and in particular the vanes of a low-pressure compressor and/or of a high-pressure compressor.

Figure 2:
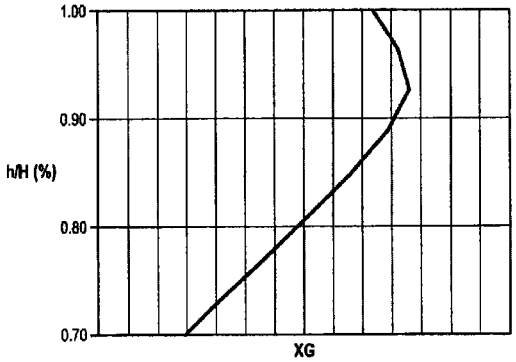
FIGS. 2 and 3 are examples of curves showing the change of the Xg and Yg laws respectively over a portion of the height of a vane according to the invention.
Figure 3:
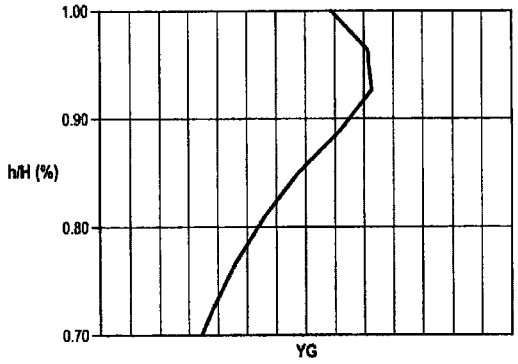

FIGS. 2 and 3 are examples of curves showing the change of the Xg and Yg laws respectively over a portion of the height of a vane according to the invention.

These two curves show the change of the longitudinal Xg and tangential Yg distribution laws defining the positioning of the respective centres of gravity of the stacked vane sections forming the vane, with respect to longitudinal X-X and tangential Y-Y axes. The ordinate axis indicates the ratio h/H, where H is the total height of the vane as defined hereinabove, and h is the height of the centre of gravity considered, measured from the base 10 of the vane.

As shown on these curves, this invention proposes a change in the direction of the slope of these Xg and Yg distribution laws in the top portion of the vane, i.e. in the upper 10% of the vane by forming the top 12.

A hook is thus observed of these two localised distribution laws for values of height between 90 and 100% of the height H of the vane starting from the base thereof.

More generally, for each of the Xg and Yg distribution laws, there is a height between 90% and 100% of the height H of the vane starting from which these two distribution laws decrease.

These heights are typically between 90% and 95% of the height H of the vane.

The value of the height between 90% and 100% of the height H of the vane starting from which the Xg distribution law decreases and the value of the height between 90% and 100% of the height H of the vane starting from which the Yg distribution law decreases can be identical or separate.

The longitudinal Xg and tangential Yg distribution laws defining the positioning of the respective centres of gravity of the stacked vane sections forming the vane, with respect to the longitudinal X-X and tangential Y-Y axes typically include a single change in the direction of the slope therein for values of height between 90 and 100% of the height H of the vane starting from the base thereof.

The vane according to the invention therefore has an airfoil that, between 90 and 100% of the height thereof starting from the base thereof, advances in the direction of the leading edge 24 and towards the suction surface, which therefore corresponds to a tipping towards the front and towards the suction surface of the top portion of the vane.

Figure 4:
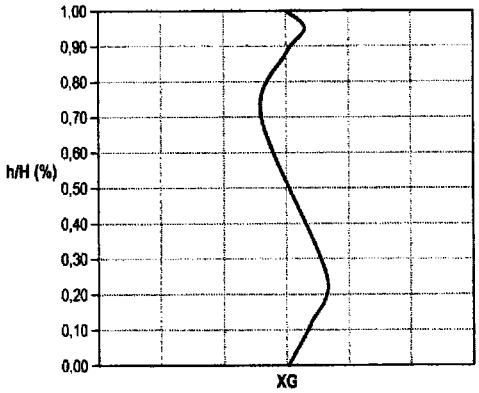
FIGS. 4 and 5 are examples of curves showing the change of the Xg and Yg laws respectively over the height of a vane according to the invention.
Figure 5:
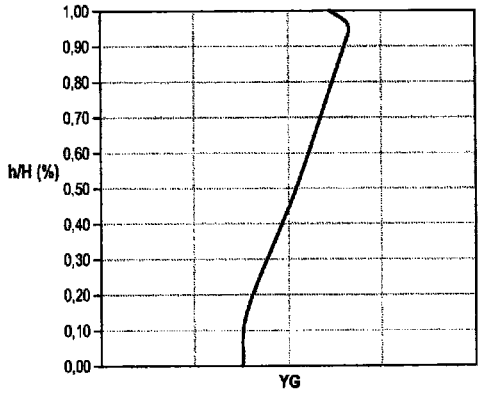

FIGS. 4 and 5 respectively show an example of longitudinal Xg and tangential Yg distribution law over the entire height of the vane.

In the same way as in FIGS. 2 and 3, a change is found in the direction of the slope of these Xg and Yg distribution laws in the top portion of the vane, i.e. in the upper 10% of the vane by forming the top 12. This change in the direction of the slope of these Xg and Yg distribution laws in the top portion of the vane is independent of the variation of the Xg and Yg laws on the rest of the height of the vane.

Figure 6:
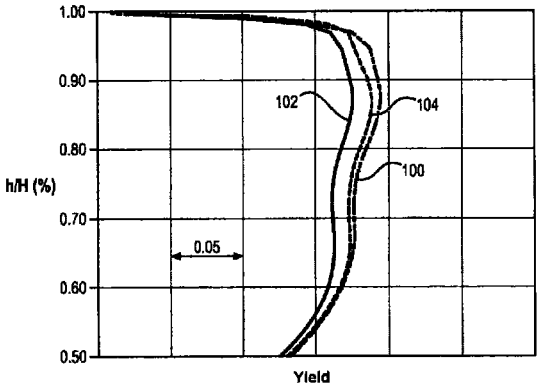
FIG. 6 is a graph showing the gain in yield obtained by a vane according to the invention with respect to known vanes.

FIG. 6 is a graph that shows the gain in yield obtained by a vane according to the invention with respect to known vanes.

The yield taken into consideration is estimated between the upstream and the downstream of the vane, taking into account pressures and temperatures upstream and downstream. This figure shows its change over the upper half of the vane, i.e. for heights ranging from H/2 to H, where H is the total height of the vane.

This figure shows three curves 100, 102 and 104, which show the yield obtained respectively with a vane according to the invention, with a vane according to prior art not having inflexion at the top, and with a vane according to prior art having an inflexion in its longitudinal distribution law Xg at the top.

As can be observed on this graph, this invention makes it possible to improve the yield in the upper portion of the vane. It is further observed that the modification of the top of the vane results in a modification of the yield over a range of heights that is clearly more extended; by modifying the geometry by 10% of the vane the aerodynamic yield of the vane is affected by more than 50%.

In addition, contrary to solutions of prior art, by modifying both the longitudinal Xg distribution law and the tangential Yg distribution law, this invention makes it possible to increase the mechanical resistance of the vane.

Indeed, the hooking of the longitudinal Xg distribution law makes it possible to reduce the static constraints in the vane. In addition, although this hooking according to Xg results in a substantial decrease in the frequency of a specific mode of the vane, here mode 4, this decrease is compensated by the hooking of the tangential Yg distribution law which results in a substantially equivalent increase in the frequency of this same mode.

The influence of the hookings according to Xg and Yg on the other specific modes is negligible.

This modification in the longitudinal Xg and tangential Yg distribution laws therefore results in an improvement in mechanical performance due to the decrease in the static constraints, without the dynamic performance being affected.

This invention has a particular application on vanes made of metal material, for example on vanes of reduced size, typically of a magnitude from 40 to 50 inches, i.e. from 101.60 cm to 127 cm.

The invention claimed is:

1. A turbomachine vane comprising:

a plurality of vane sections stacked along a radial axis, with each vane section extending along a longitudinal axis between a leading edge and a trailing edge, and according to a tangential axis between a pressure surface and a suction surface, with the vane sections being distributed according to longitudinal and tangential distribution laws defining positioning of respective centers of gravity thereof with respect to the longitudinal and tangential axes according to a height of the vane extending from a foot of the vane to a top of the vane, wherein, in a top section of the vane located between 90 and 100% of the height of the vane there is a first height starting from which the longitudinal distribution law carries out a first return towards the leading edge of the vane, there is a second height starting from which the tangential distribution law carries out a second return towards the suction surface of the vane, and wherein the first and second heights are equal.

2. A turbomachine vane according to claim 1, wherein the first and second heights are between 90% and 95% of the height of the vane.

3. A turbomachine vane according to claim 1, wherein the vane is made from a metal material.

4. A turbomachine fan comprising a plurality of vanes according to claim 1.

5. A high-pressure compressor of a turbomachine, comprising a plurality of vanes according to claim 1.

6. A low-pressure compressor of a turbomachine, comprising a plurality of vanes according to claim 1.

7. A turbomachine comprising a plurality of vanes according to claim 1.

* * * * *